US012673751B2

(12) United States Patent
Ward et al.

(10) Patent No.: US 12,673,751 B2
(45) Date of Patent: Jul. 7, 2026

(54) SHALLOW WATER ANCHOR

(71) Applicant: Lippert Components, Inc., Elkhart, IN (US)

(72) Inventors: Thomas F. Ward, Downingtown, PA (US); Joseph M. Lassandro, III, Schuylkill Haven, PA (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 399 days.

(21) Appl. No.: 18/234,546

(22) Filed: Aug. 16, 2023

(65) Prior Publication Data

US 2024/0059377 A1 Feb. 22, 2024

Related U.S. Application Data

(60) Provisional application No. 63/399,428, filed on Aug. 19, 2022.

(51) Int. Cl.
*B63B 21/29* (2006.01)

(52) U.S. Cl.
CPC ..... *B63B 21/29* (2013.01)

(58) Field of Classification Search
CPC ..... B64B 21/29; B63B 21/24
USPC ..... 114/295
See application file for complete search history.

(56) References Cited

U.S. PATENT DOCUMENTS 2,804,838 A * 9/1957 Moser ..... B63H 20/007 440/58
4,482,330 A 11/1984 Cook
5,307,753 A * 5/1994 Besonen, Sr. ..... B63B 21/20 114/230.18
5,742,988 A 4/1998 Swetish
6,041,730 A 3/2000 Oliverio et al.
6,132,271 A 10/2000 Hebert
7,972,188 B2 7/2011 Bernloehr et al.
8,495,963 B2 7/2013 Bernloehr et al.
8,661,999 B2 3/2014 Blom
8,677,919 B2 3/2014 Bernloehr et al.
8,752,498 B1 6/2014 Schwindaman et al.
8,839,730 B2 9/2014 Shamblin
9,145,188 B1 9/2015 Daneman
9,517,827 B2 12/2016 Shamblin et al.
9,745,022 B1 8/2017 Kuenzel
9,834,292 B1 12/2017 Drozdowski et al.
10,029,764 B2 7/2018 Bernloehr et al.
10,315,730 B2 6/2019 Baker (Continued)

FOREIGN PATENT DOCUMENTS

KR 101001491 B1 * 12/2010 ..... B63B 21/20
WO WO 03/064251 A1 8/2003

OTHER PUBLICATIONS

U.S. Statutory Inventory Registration H1051; Filed May 10, 1991, published May 5, 1992; Briguglio (Year: 1992).*

(Continued)

*Primary Examiner* — Magdalena Topolski
*Assistant Examiner* — Shanna Danielle Glover
(74) *Attorney, Agent, or Firm* — NIXON & VANDERHYE P.C.

(57) ABSTRACT

A shallow water anchor system includes a motor, a four-bar linkage displaceable by the motor between a stowed position and a deployed position, and a ground spike coupled with the four-bar linkage. The four-bar linkage maintains an orientation of the ground spike regardless of a position of the four-bar linkage.

16 Claims, 14 Drawing Sheets

(56) References Cited

U.S. PATENT DOCUMENTS

| | | | | |
|---|---|---|---|---|
| 10,526,050 | B1 | 1/2020 | Turek et al. | |
| 10,940,919 | B2 | 3/2021 | Rooke | |
| 10,994,811 | B1 | 5/2021 | Smith | |
| 11,066,130 | B2 | 7/2021 | Harrod | |
| 2009/0223429 | A1 | 9/2009 | Kuenzel | |
| 2009/0223430 | A1* | 9/2009 | Kuenzel | B63B 21/26 114/230.13 |
| 2010/0230450 | A1 | 9/2010 | Tomberli | |
| 2014/0161521 | A1* | 6/2014 | Ball | E01F 13/046 404/6 |
| 2015/0298771 | A1 | 10/2015 | Kuenzel | |
| 2023/0313830 | A1* | 10/2023 | Tulloch | B64F 5/10 411/535 |

OTHER PUBLICATIONS

Minn Kota Raptor, https://mygreenoutdoors.com/minn-kota-raptor-8-shallow-water-anchor-black-1810600/?msclkid=96b15001bde6100c25e7316453719d34&utm_source=bing&utm_medium=cpc&utm_campaign=Shopping%20-%20Minn%20Kota%20-%20Desktop%2FTablet%20(Medium)&utm_term=4581458797064031&utm_content=Minn620Kota, website pages, printed out on Aug. 16, 2023, origination date unknown, 5 pp.

Minn Kota Talon Travel Cover-15', https://minnkotamotors.johnsonoutdoors.com/accessories/shallow-water-anchor/talon-travel-cover-15?force-country=US&gclid=EAIaIQobChMitcun0o_l8wlVggh9Ch1zpwisEAQYBCABEglsfvD_BwE&gclsrc=aw.ds, website pages, printed out on Aug. 16, 2023, origination date unknown, 3 pp.

Royz Shallow Water Anchor (SWA)—2nd Gen, https://tbnation.net/products/royz-shallow-water-anchor-swa?variant=34831424225415&currency=USD&utm_medium=product_sync&utm_source=google&utm_content=sag_organc&utm_campaign=sag_organic&utm_campaign=gs-2021-08-11&utm_source=google&utm_medium=smart_campaign, website pages, printed out on Aug. 16, 2023, origination date unknown, 5 pp.

* cited by examiner

SHALLOW WATER ANCHOR

CROSS-REFERENCES TO RELATED APPLICATIONS

This application claims the benefit of U.S. Provisional Patent Application Ser. No. 63/399,428, filed Aug. 19, 2022, the entire content of which is herein incorporated by reference.

STATEMENT REGARDING FEDERALLY SPONSORED RESEARCH OR DEVELOPMENT (NOT APPLICABLE)

BACKGROUND

The invention relates to a shallow water anchor and, more particularly, to an electrically driven shallow water anchor system incorporating a four-bar linkage and a ground spike.

Typical shallow water anchors are rigidly affixed to a marine vessel. When retracted, the shallow water anchor is positioned above the waterline and allows the vessel to function normally. When deployed, a ground spike is driven into the sea floor to anchor the vessel in place. Shallow water anchors typically function in less than 12 feet of water depth, though some extend as far as 15 feet.

Existing systems utilize hydraulic actuators that drop below the waterline during full deployment, which can result in corrosion and associated degradation of the system. Furthermore, these systems typically require the use of a powered hydraulic pump, which must be installed in the vessel, taking up valuable space.

Existing systems also lack a break away safety feature. Some utilize an audible alarm to indicate that the system is deployed on vessel power up, but there are many instances where users still drive away with the anchor deployed, which results in damage to the anchor as well as the vessel. When a hydraulic system fails, pressure relief must be activated to manually move the system. In some existing products, the system requires a total disassembly to recover from a failure of the hydraulic system.

Shallow water anchors are typically connected to vessels via bolts or the like, often requiring direct drilling through the transom of the vessel. Alternatively, existing anchors may attach to brackets via traditional bolts where the brackets are fixed to the vessel via transom drill holes. These designs are permanently affixed to the vessels and can cause issues for trailering and storing the vessel in covered storage.

Current anchors typically have a fixed maximum deployment depth, which is directly correlated to the retracted height on the vessel. Taller retracted heights allow for deeper deployment depths, but these systems experience issues with trailering and covered storage.

Finally, current anchors often utilize a check valve to try to absorb boat movement. Due to the orientation of the hydraulic ram and check valve, however, most of the motion is lost in the linkage, causing the vessel to become unanchored.

SUMMARY

It would thus be desirable to provide a shallow water anchor system that overcomes the drawbacks of existing designs. The shallow water anchor system of the described embodiments includes an electrically driven rotary actuator, a four-bar linkage armature mechanism, and a ground spike.

The system also includes specialized mounting componentry, a wire harness and a singular switch to actuate the system. In other embodiments, the control system may include a wireless switch. In the present embodiment, there is no circuit board or chip controlling the system, but Bluetooth or WiFi applications could be used in other embodiments.

The electric actuator is mounted to the vessel above the waterline, which reduces the potential for corrosion related damage. The drive system is compact and fully self-contained, connecting to the vessel via two power leads allowing for simple installation and effective use of space.

In some embodiments, the main drive arm is readily decoupled from the spur gear via a quick disconnect pin, which allows the user to easily reposition the system in the event of a motor failure or power loss. The system also includes a quick mount that allows for rapid installation and removal of the system for usage and transport or storage. Telescoping armature components allow for the retracted height of the system to be minimized for trailering and storage.

In an exemplary embodiment, a shallow water anchor system includes a motor, a four-bar linkage displaceable by the motor between a stowed position and a deployed position, and a ground spike coupled with the four-bar linkage. The four-bar linkage maintains an orientation of the ground spike regardless of a position of the four-bar linkage.

The four-bar linkage may include a drive arm that pivots on a first pivot point, a pivot arm that pivots on a second pivot point spaced from the first pivot point, and a link pivotally connected between distal ends of the drive arm and the pivot arm. In this context, the ground spike may be connected to the link. The motor may be configured to reciprocate a rack between a retracted position and an extended position, and the drive arm may be connected to a spur gear at a proximal end that engages the rack. The ground spike may be connected to the link via a ramped interlock mechanism that may be configured to secure the ground spike at a user-defined angle relative to the four-bar linkage. The ramped interlock mechanism may be configured such that when an excessive lateral load is applied to the ground spike, the ramped interlock mechanism will allow the ramps to skip. The drive arm may include telescoping sections, and the pivot arm may include telescoping sections. The anchor system may further include a strut pivotally connected to the drive arm and the pivot arm, where the motor is coupled with the strut and is configured to extend and retract the strut.

The four-bar linkage may be coupled to a frame member, and the anchor system may additionally include a clamp fixed to the frame member, where the clamp is configured to secure the shallow water anchor system to a boat. The clamp may include thumb screws.

The ground spike may include an inline embedded gas shock.

In another exemplary embodiment, a shallow water anchor system includes a motor, a strut displaceable by the motor between an extended position and a retracted position, a four-bar linkage displaceable via the strut between a stowed position and a deployed position, and a ground spike coupled with the four-bar linkage.

In yet another exemplary embodiment, a shallow water anchor system includes a motor, a four-bar linkage displaceable by the motor between a stowed position and a deployed position, a ground spike coupled with the four-bar linkage, and a shock absorber cooperable with the ground spike and configured to absorb external forces on the ground spike.

The shock absorber may include a gas shock that is in line with and embedded in the ground spike. The gas shock may be positioned between upper and lower portions of the ground spike.

The shock absorber may include one of a hydraulic shock and a resilient material.

BRIEF DESCRIPTION OF THE DRAWINGS

These and other aspects and advantages will be described in detail with reference to the accompanying drawings, in which.

DETAILED DESCRIPTION

Figure 1:
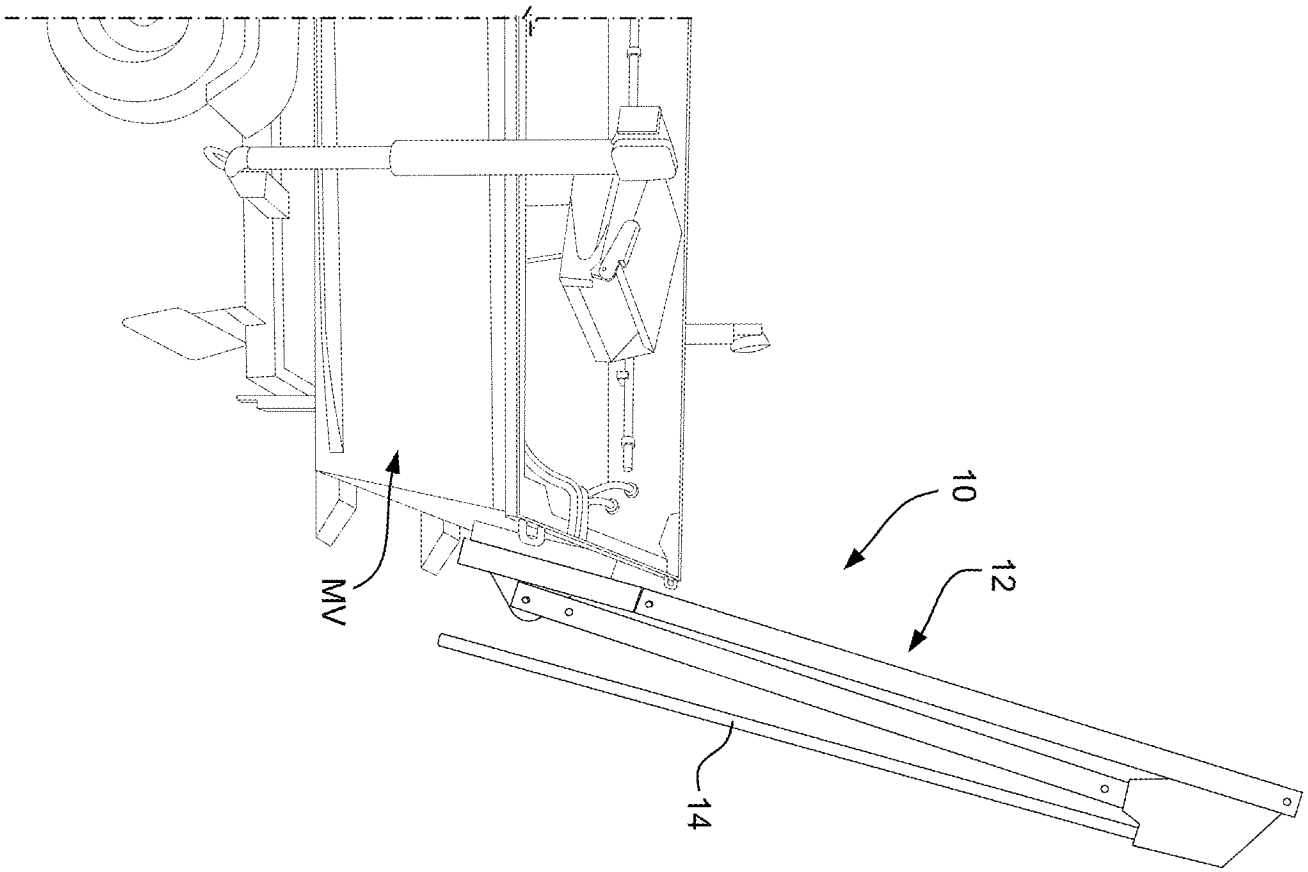
FIG. 1 shows the shallow water anchor system in a stowed position.
Figure 2:
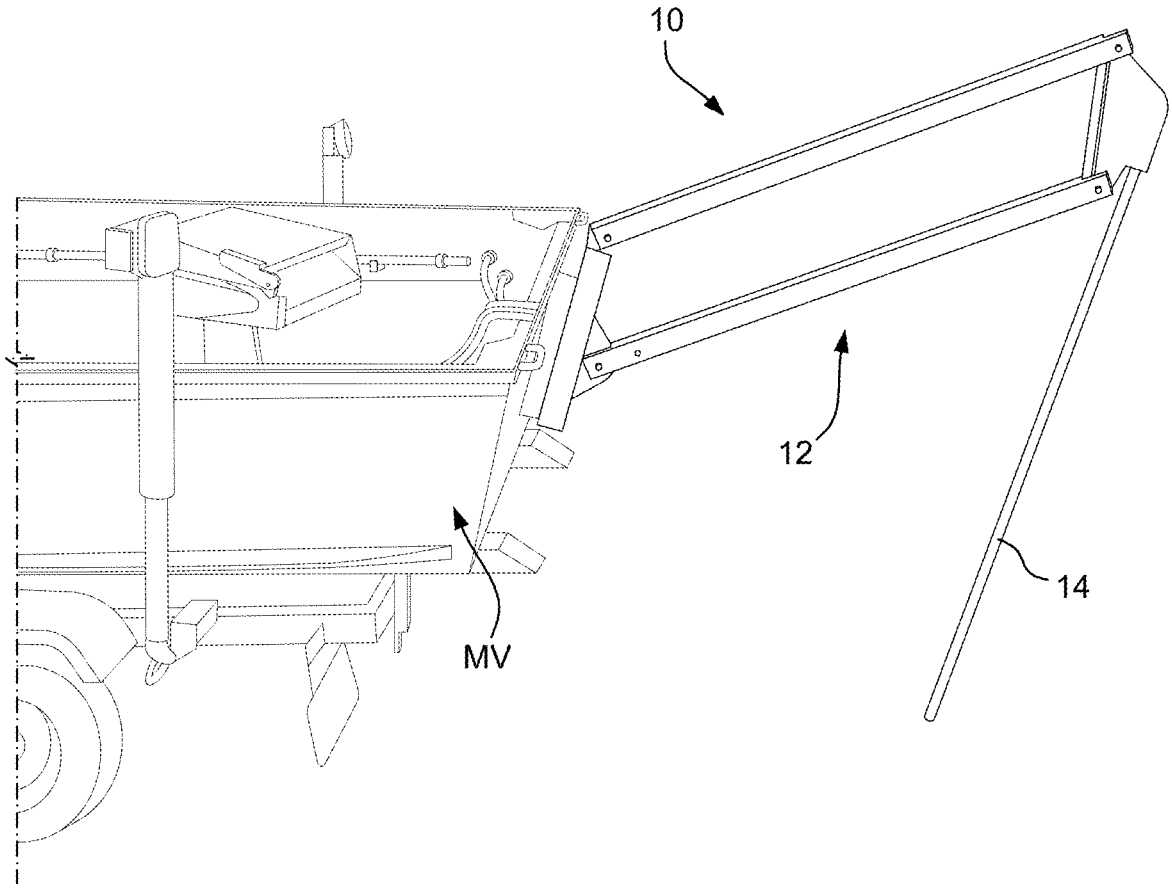
FIG. 2 shows the shallow water anchor system in a part-deployed position.

FIGS. 1 and 2 show a shallow water anchor system 10 of the described embodiments secured on a marine vessel MV. An actuator drives a four-bar linkage 12 between a stowed position (FIG. 1) and a deployed position (part-deployed position shown in FIG. 2).

A ground spike 14 is coupled with the four-bar linkage 12. When deployed, the ground spike 14 is driven into the sea floor to anchor the vessel MV in place. The four-bar linkage 12 maintains an orientation of the ground spike 14 regardless of a position of the four-bar linkage 12.

Figure 3:
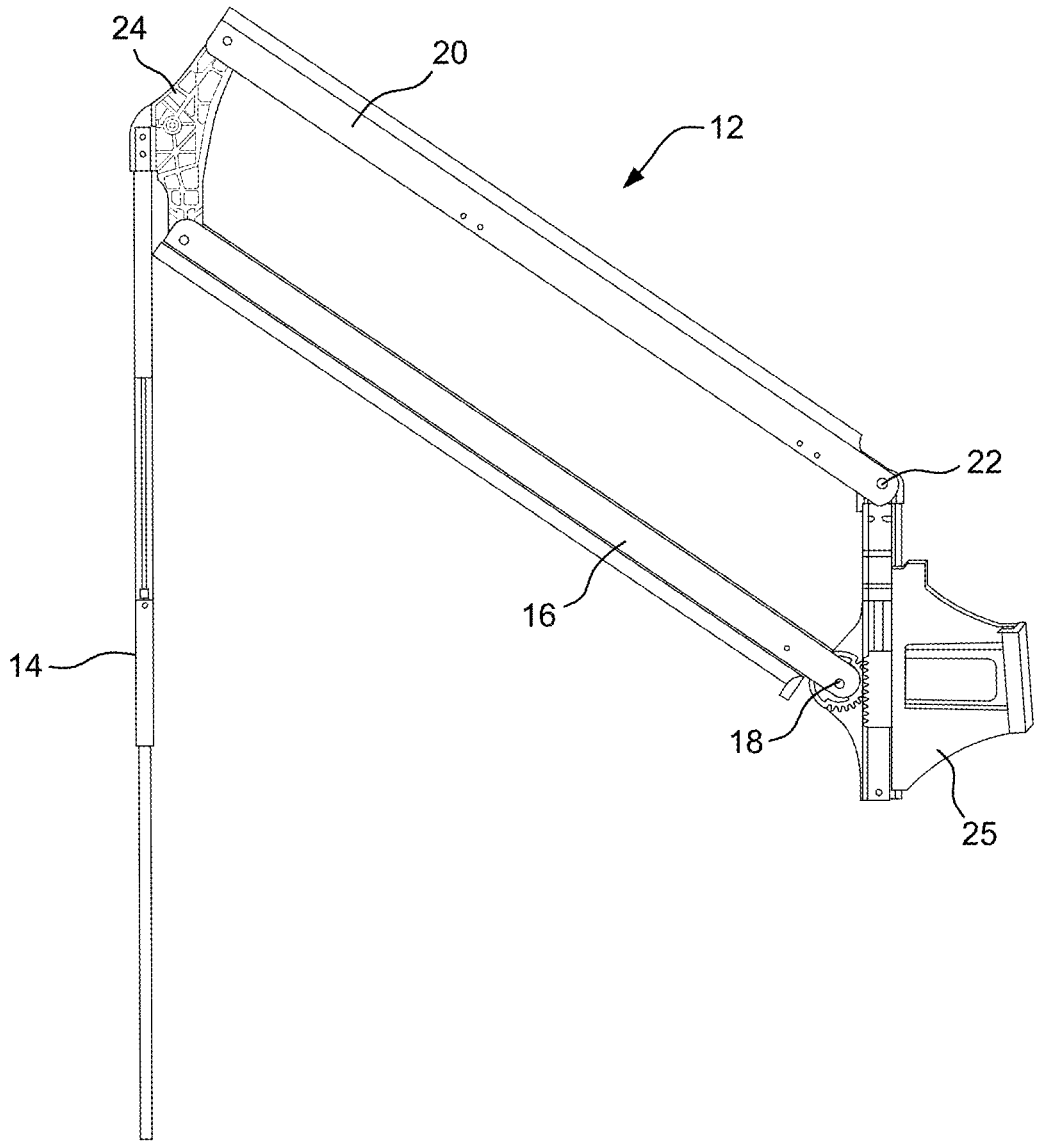
FIG. 3 shows the shallow water anchor system in a part-deployed position.

With reference to FIG. 3, the four-bar linkage 12 includes a drive arm 16 that pivots on a first fixed pivot point 18, and a pivot arm 20 that pivots on a second fixed pivot point 22 spaced from the first pivot point 18. A link 24 is pivotally connected between distal ends of the drive arm 16 and the pivot arm 20, and the ground spike 14 is connected to the link 24. With this configuration, an orientation of the ground spike 14 relative to the four-bar linkage 12 is kept constant regardless of a position of the four-bar linkage 12. The four-bar linkage 12 is coupled to a frame member 25.

Figure 4:
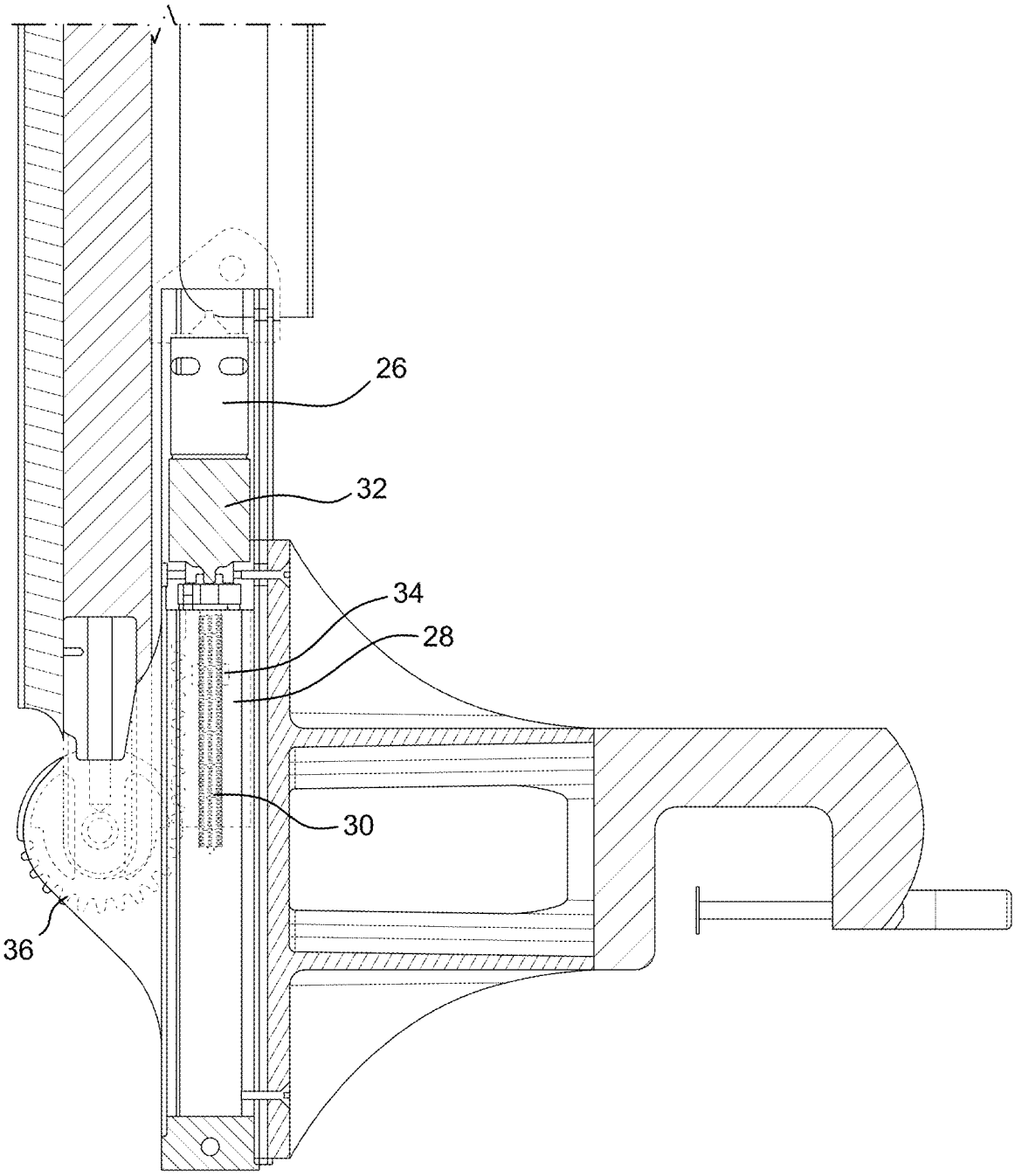
FIGS. 4 and 5 are a close-up view of the actuator for deploying and stowing the shallow water anchor system.
Figure 5:
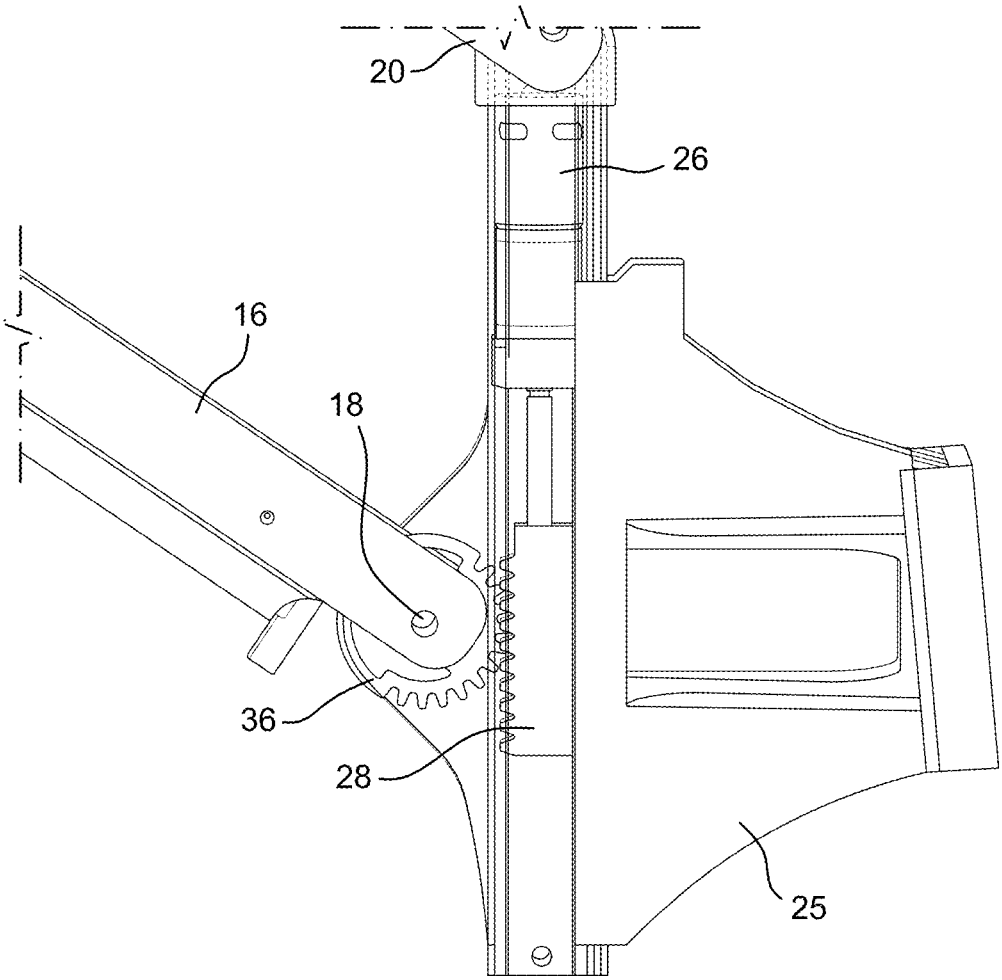

FIGS. 4 and 5 show details of an exemplary actuator for driving the shallow water anchor system 10 between the stowed position and the deployed position. The exemplary actuator is similar to the actuator described in U.S. Pat. No. 8,752,498, the contents of which are hereby incorporated by reference. A motor 26 is connected to a power source via a wire harness (not shown) and connects to the vessel MV via two power leads allowing for simple installation and effective use of space. A singular switch may be provided to activate the system. In an exemplary construction, there is no circuit board or chip controlling the system. In other embodiments, Bluetooth or Wifi systems incorporating a circuit board may be used to control the system.

The motor 26 is configured to reciprocate a rack 28 between a retracted position and an extended position. As would be appreciated by those of ordinary skill in the art, reciprocation of the rack 28 can be achieved using various means. In the exemplary construction shown in FIG. 4, the motor 26 drives a lead screw 30 via a gearbox 32. A lead screw nut 34 is fixed to or otherwise embedded in the rack 28 and engages threads of the lead screw 30. As such, as the lead screw 30 is rotated by the motor 26, the lead screw nut 34 and thereby the rack 28 are displaced linearly.

The rack 28 engages with a spur gear 36 that is connected to a proximal end of the drive arm 16. With particular reference to FIG. 5, as the rack 28 is extended (downward in FIG. 5), the drive arm 16 is displaced clockwise about the first pivot point 18. Displacement of the drive arm 16 displaces the entire four-bar linkage 12.

The drive system including the motor 26, the rack 28 and the spur gear 36 are mounted to the vessel MV above the waterline, which reduces the potential for corrosion-related damage. As shown, the drive system is compact and fully self-contained, allowing for effective and efficient use of space.

Figure 7:
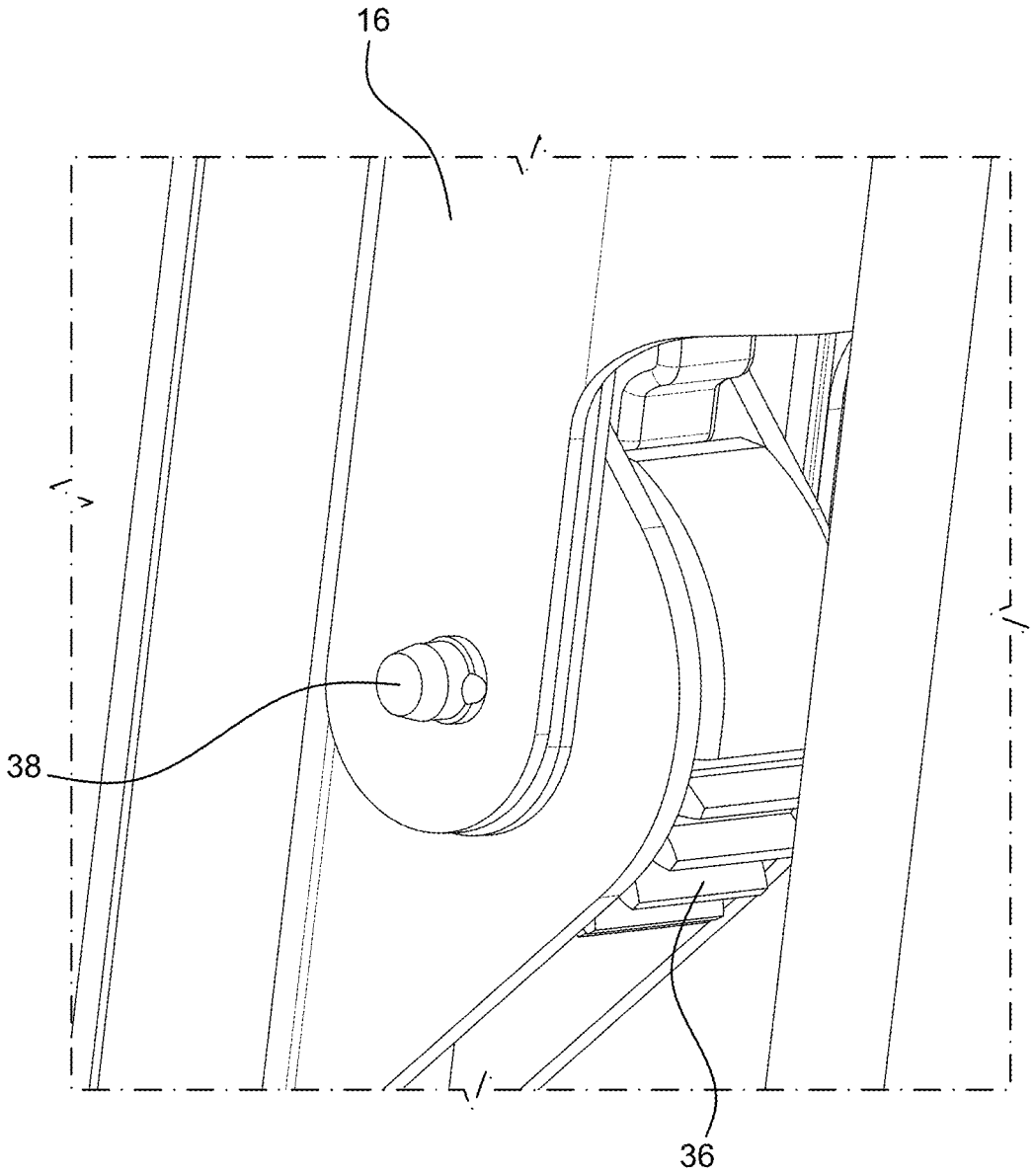
FIGS. 7 and 8 show the connection between a drive arm and a spur gear via a quick disconnect pin.
Figure 8:
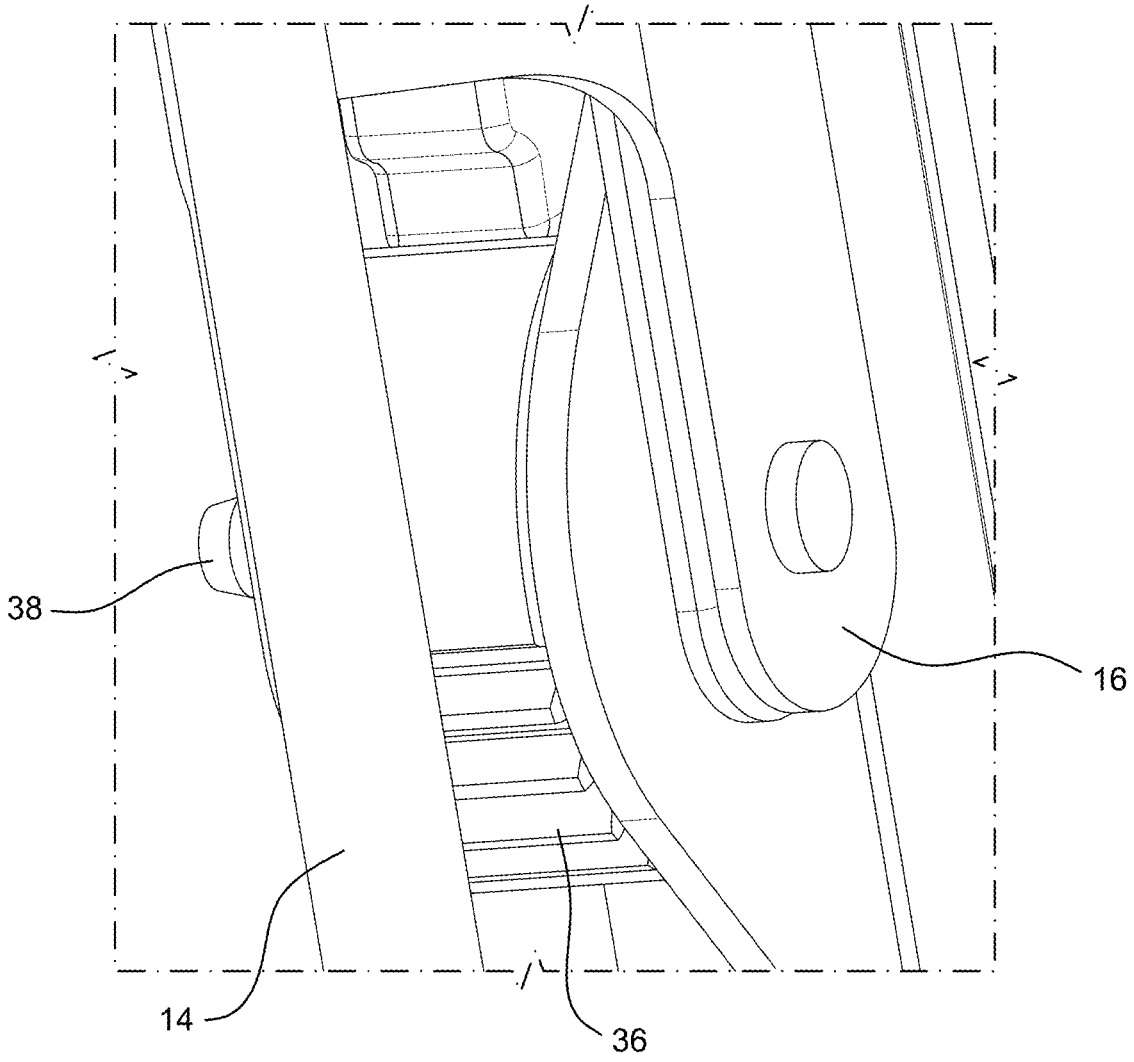

In some embodiments, with reference to FIGS. 7 and 8, the drive arm 16 is connected to the spur gear 36 via a quick disconnect pin 38. Decoupling of the drive arm 16 from the spur gear 36 allows the user to easily reposition the system in the event of a motor failure or power loss. Removing the pin 38 also enables the user to manually extend or retract the system.

Figure 11:
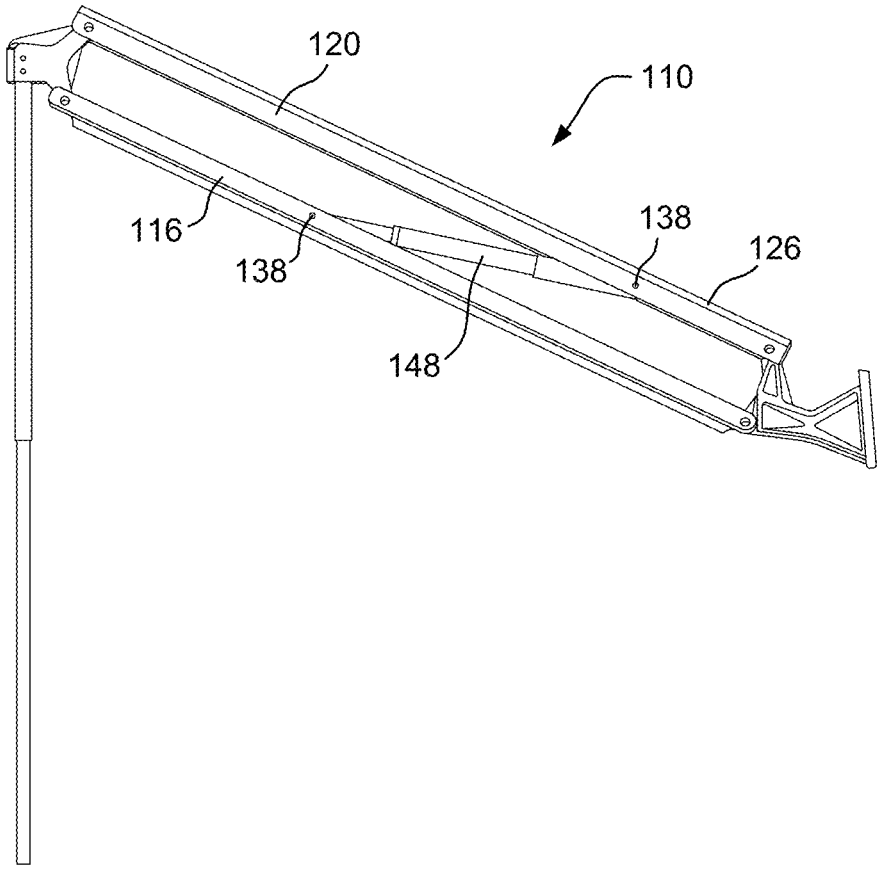
FIG. 11 shows an alternative embodiment of the shallow water anchor actuator in a part-deployed position.
Figure 12:
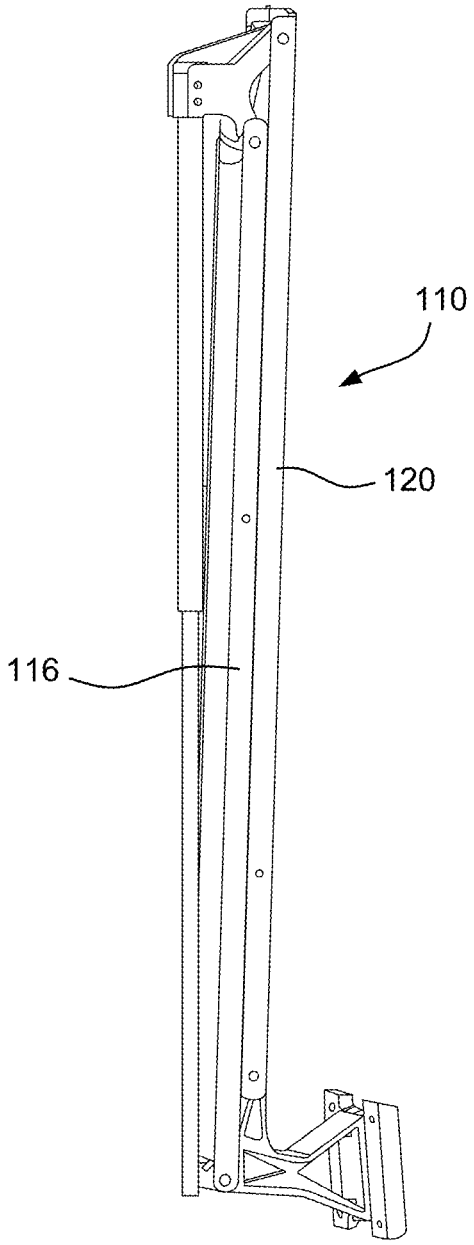
FIG. 12 shows the shallow water anchor of FIG. 11 in a stowed position.
Figure 13:
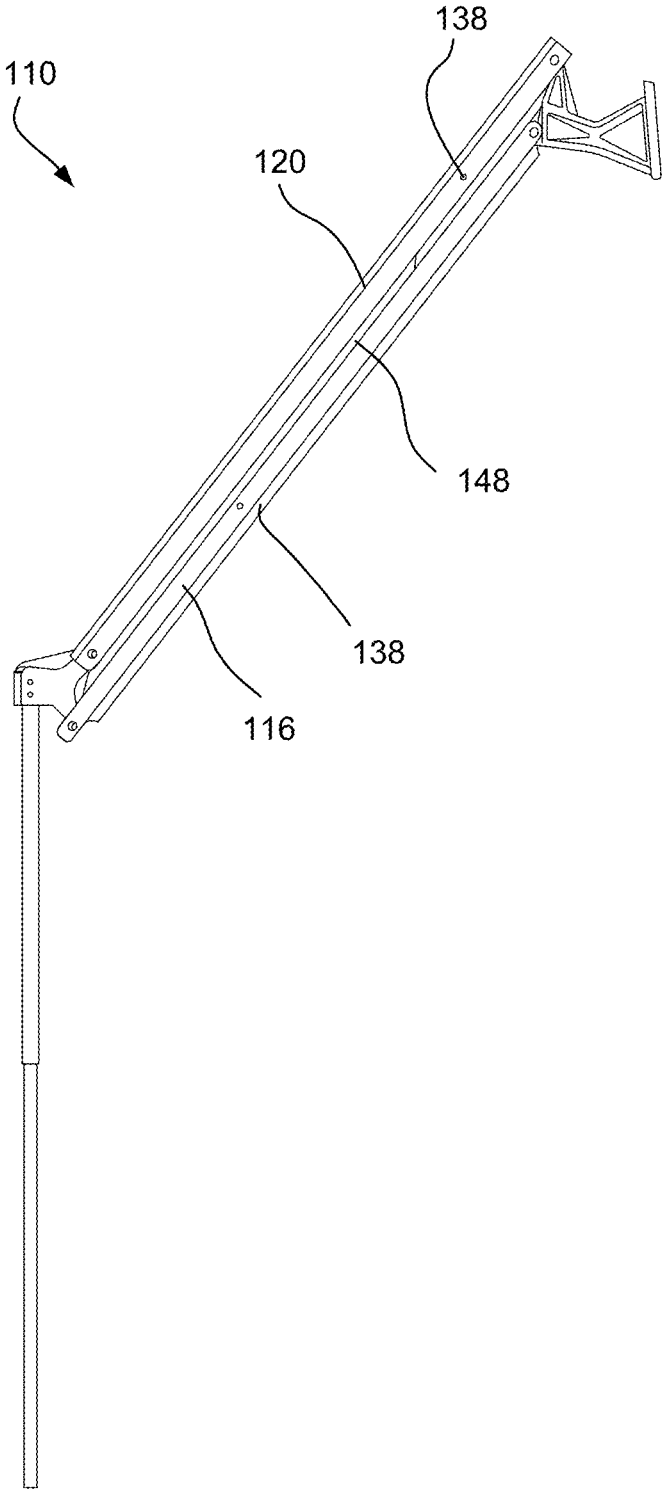
FIG. 13 shows the shallow water anchor of FIG. 11 in a fully deployed position

FIGS. 11-13 show details of another exemplary actuator for driving a shallow water anchor system 110 between the stowed position and the deployed position. A motor 126 is connected to a power source or may be battery-powered. The motor 126 is mounted to the system such that it remains above the waterline, which reduces the potential for corrosion-related damage. The motor 126 is configured to extend and retract a strut 148 that is pivotally connected to both the drive arm 116 and the pivot arm 120. The anchor system 110 is shown in the retracted position in FIG. 12 when the strut 148 is fully retracted. The anchor system 110 is shown in the extended position in FIG. 13 when the strut 148 is fully extended. The strut 148 may be mounted by removable pins 138 to both the drive arm 116 and the pivot arm 120 so that either pin can be removed so that the user can easily reposition the system in the event of a motor failure or power loss. As shown, the drive system of anchor system 110 is also compact and fully self-contained, allowing for effective and efficient use of space. Other features of the shallow water anchor system 110 are substantially similar to corresponding features of the shallow water anchor system 10 described above and below.

Figure 6:
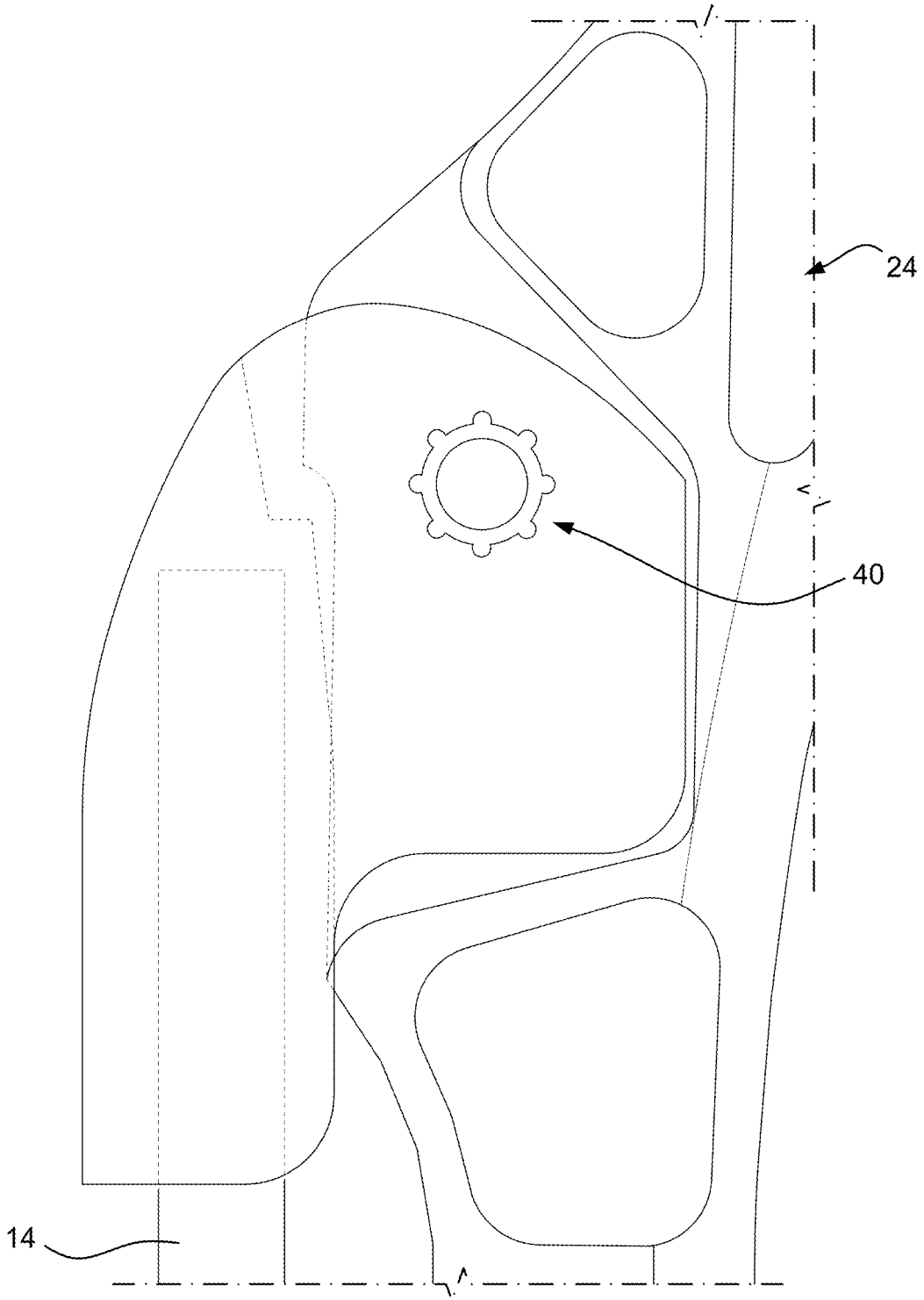
FIG. 6 shows a ramped interlock mechanism for securing the ground spike at a user-defined angle.
Figure 6A:
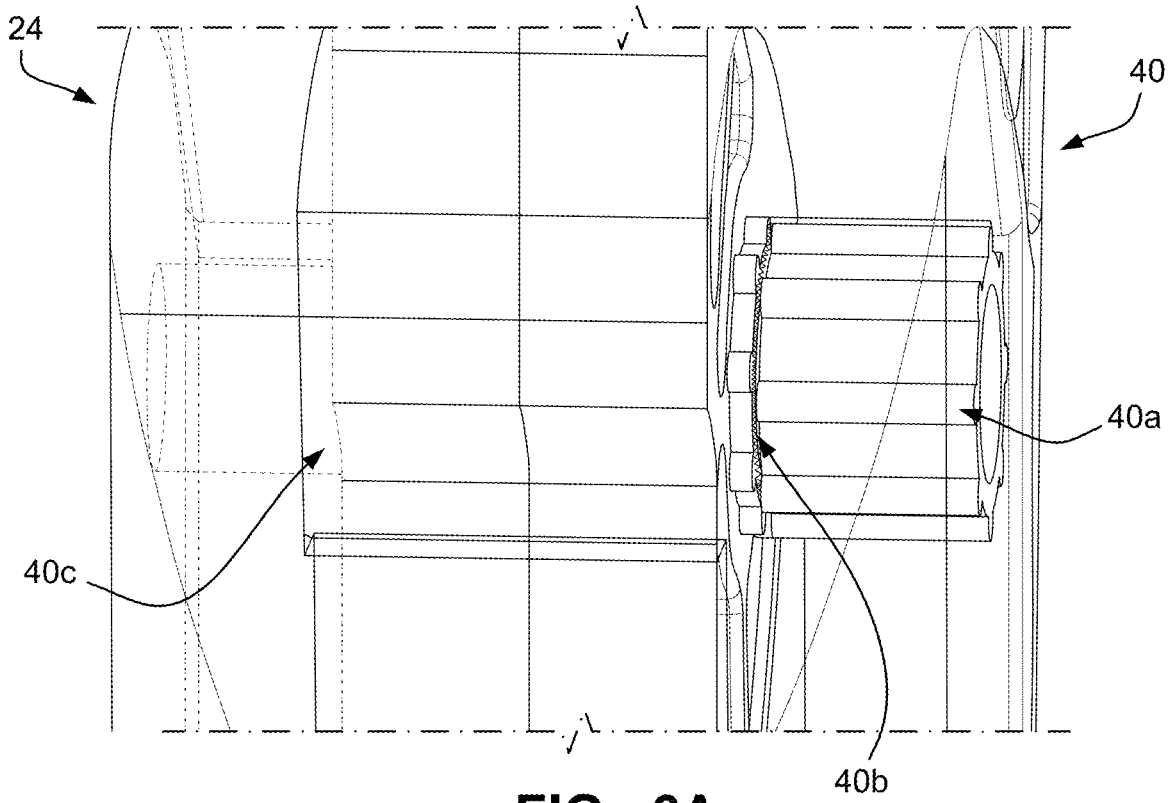
FIG. 6A is an end view of the link showing components of the interlock mechanism.

With reference to FIG. 6, the ground spike 14 may be connected to the link 24 via a ramped interlock mechanism 40 that is configured to secure the ground spike 14 at a user-defined angle relative to the four-bar linkage 12. The ramped interlock mechanism 40 is provided with a plurality of ramp features at discrete angular positions. In the event that an excessive lateral load is applied to the ground spike 14, the ramped interlock mechanism 40 will allow the ramps to skip, thereby protecting the system as a whole and the vessel MV at the attachment point. FIG. 6A is an end view of the link 24 showing components of the interlock mechanism 40. A plurality of radius splines 40*a* (eight in FIG. 6A) prevent two splined hubs containing locking teeth 40*b* from rotating within their respective parts. The locking teeth 40*b* provide a holding force under normal loads. A stack of Bellville spring washers may be positioned on a post 40*c* that serve to keep constant force on the locking teeth 40*b*. Once a great enough force is seen in the anchoring spike 14, the springs would compress and allow the teeth 40*b* to disengage, thereby allowing the spike 14 to rotate upward out of the way.

Figure 9:
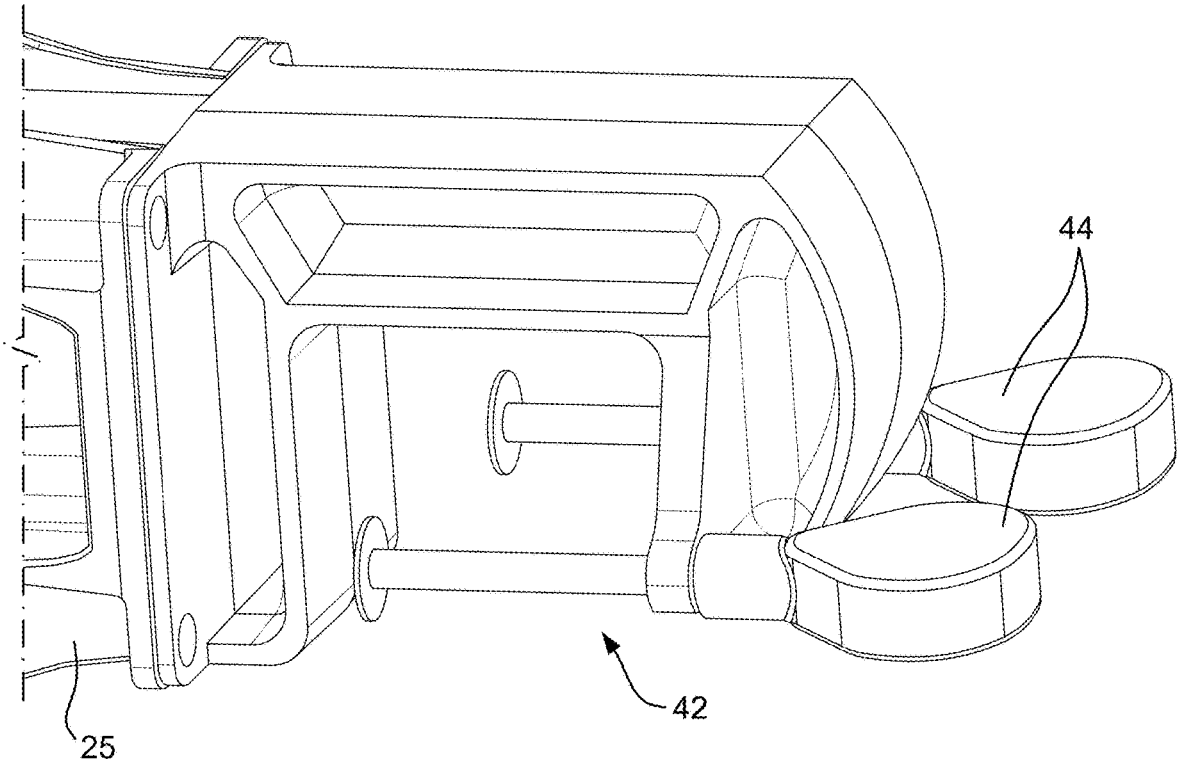
FIG. 9 shows an exemplary clamp for securing the system to a vessel.

FIG. 9 shows a clamp 42 that is configured to secure the system 10, 110 to the vessel MV. The clamp 42 may be secured to the frame member 25. In some embodiments, the clamp 42 utilizes thumb screws 44 for securing the system 10, 110 to the marine vessel MV. The clamp 42 enables the system 10, 110 to be rapidly rigidly affixed to the vessel MV without requiring tools. The clamp 42 similarly allows for rapid removal of the system for transport or storage. The clamp 42 thus allows for smaller lower-cost vessels to utilize the system and allows for the system to only be installed and utilized when needed.

In some embodiments, the drive arm 16, 116 and the pivot arm 20, 120 may include telescoping sections so that links of the drive arm 16, 116 and the pivot arm 20, 120 can be adjusted. The telescoping structure allows for the retracted height of the system to be adjusted on the fly, which enables the user to increase or decrease the maximum deployment depth. The retracted height of the system can thus be minimized for trailering and storage. In the event that the user requires a deeper deployment depth while using the system, the user can rapidly and easily extend the length of the system without requiring tools.

Figure 10:
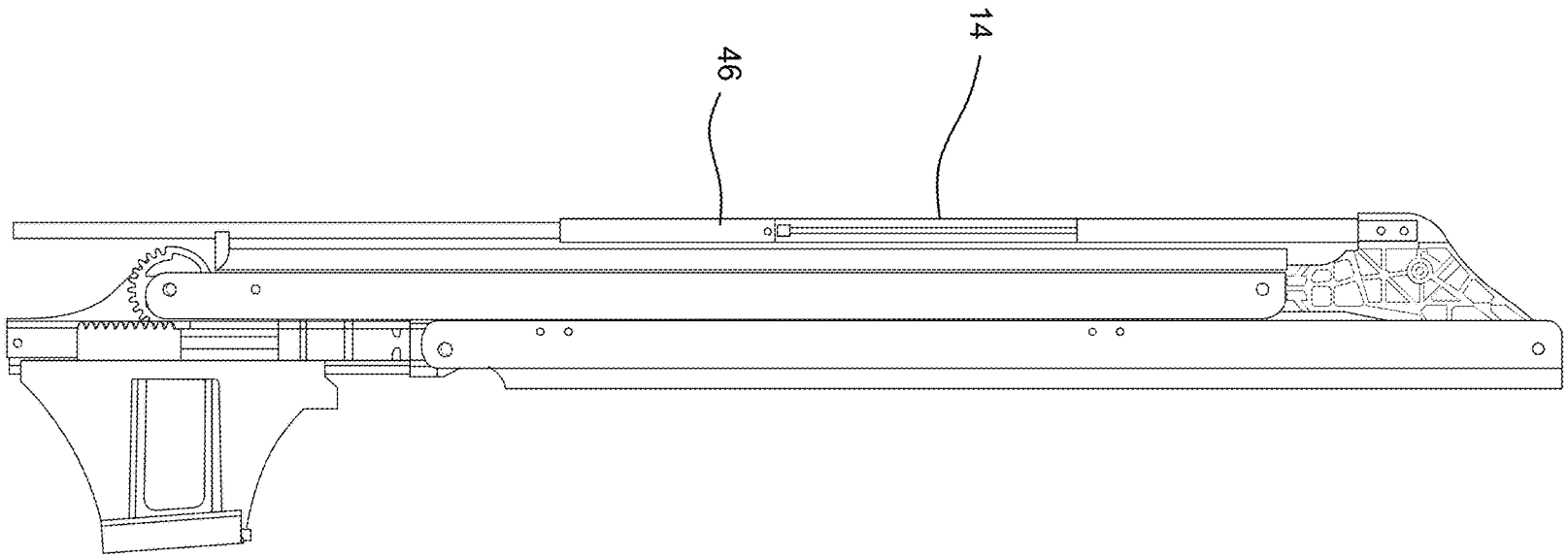
FIG. 10 shows a variation of the ground spike incorporating an inline embedded gas shock.

As shown in FIG. 10, the ground spike 14 may be provided with an inline embedded gas shock 46. The gas shock 46 provides for maximum vessel holding during rough sea conditions due to the shock being in line with the ground spike 14. That is, as the vessel is shifted in use by wind or rough seas or the like, the gas shock 46 can absorb boat movement to maintain a secure ground connection and improve functionality. In some embodiments, the gas shock 46 may be located between upper and lower portions of the spike. The shock absorber may alternatively be a hydraulic shock or a resilient material such as rubber or foam.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A shallow water anchor system comprising:

a motor;

a four-bar linkage displaceable by the motor between a stowed position and a deployed position;

a ground spike coupled with the four-bar linkage, the four-bar linkage maintaining an orientation of the ground spike regardless of a position of the four-bar linkage; and a strut operatively coupled to the motor and configured to extend and retract, the strut being pivotally connected to a drive arm of the four-bar linkage at a first intermediate pivot location spaced from proximal and distal ends of the drive arm and pivotally connected to a pivot arm of the four-bar linkage at a second intermediate pivot location spaced from proximal and distal ends of the pivot arm, wherein the strut extends diagonally between the drive arm and the pivot arm to define a diagonal across the four-bar linkage, and wherein extension and retraction of the strut changes a distance between the first pivot location and the second pivot location to thereby displace the four-bar linkage between the stowed position and the deployed position.

2. The shallow water anchor system according to claim 1, wherein the four-bar linkage comprises a link pivotally connected between distal ends of the drive arm and the pivot arm, and wherein the ground spike is connected to the link.

3. The shallow water anchor system according to claim 2, further comprising a rack, wherein the motor is configured to reciprocate the rack between a retracted position and an extended position, and wherein the drive arm is connected to a spur gear at a proximal end that engages the rack.

4. The shallow water anchor system according to claim 2, wherein the ground spike is connected to the link via a ramped interlock mechanism that is configured to secure the ground spike at a user-defined angle relative to the four-bar linkage.

5. The shallow water anchor system according to claim 4, wherein the ramped interlock mechanism comprises ramps and is configured such that when an excessive lateral load is applied to the ground spike, the ramped interlock mechanism will allow the ramps to skip.

6. The shallow water anchor system according to claim 1, wherein the four-bar linkage is coupled to a frame member, the shallow water anchor system further comprising a clamp fixed to the frame member, wherein the clamp is configured to secure the shallow water anchor system to a boat.

7. The shallow water anchor system according to claim 6, wherein the clamp comprises thumb screws.

8. The shallow water anchor system according to claim 1, wherein the ground spike comprises an inline embedded gas shock.

9. A shallow water anchor system comprising:

a motor;

a strut displaceable by the motor between an extended position and a retracted position;

a four-bar linkage displaceable via the strut between a stowed position and a deployed position; and a ground spike coupled with the four-bar linkage, the four-bar linkage maintaining an orientation of the ground spike regardless of a position of the four-bar linkage, wherein the four-bar linkage comprises a drive arm that pivots about a first pivot point and a pivot arm that pivots about a second pivot point spaced from the first pivot point, wherein a first end of the strut is pivotally connected to the drive arm at a third pivot point located between proximal and distal ends of the drive arm, and a second end of the strut is pivotally connected to the pivot arm at a fourth pivot point located between proximal and distal ends of the pivot arm, wherein the strut extends diagonally between the drive arm and the pivot arm to define a diagonal across the four-bar linkage, and wherein movement of the strut between the extended position and the retracted position changes a distance between the third pivot point and the fourth pivot point to thereby displace the four-bar linkage between the stowed position and the deployed position.

10. The shallow water anchor system according to claim 9, wherein the four-bar linkage comprises a drive arm that pivots on a first pivot point, a pivot arm that pivots on a second pivot point spaced from the first pivot point, and a link pivotally connected between distal ends of the drive arm and the pivot arm, and wherein the ground spike is connected to the link.

11. The shallow water anchor system according to claim 10, wherein the ground spike is connected to the link via a ramped interlock mechanism that is configured to secure the ground spike at a user-defined angle relative to the four-bar linkage.

12. The shallow water anchor system according to claim 9, wherein the four-bar linkage is coupled to a frame member, the shallow water anchor system further comprising a clamp fixed to the frame member, wherein the clamp is configured to secure the shallow water anchor system to a boat.

13. The shallow water anchor system according to claim 9, wherein the ground spike comprises an inline embedded gas shock.

14. A shallow water anchor system comprising:

a motor;

a four-bar linkage displaceable by the motor between a stowed position and a deployed position;

a ground spike coupled with the four-bar linkage, the four-bar linkage maintaining an orientation of the ground spike regardless of a position of the four-bar linkage; and a shock absorber cooperable with the ground spike and configured to absorb external forces on the ground spike, wherein the shock absorber comprises a gas shock that is in line with and embedded in the ground spike.

15. The shallow water anchor system according to claim 14, wherein the gas shock is positioned between upper and lower portions of the ground spike.

16. The shallow water anchor according to claim 14, wherein the shock absorber comprises one of a hydraulic shock and a resilient material.

* * * * *